United States Patent [19]

Buchanan

[11] Patent Number: 4,872,321

[45] Date of Patent: Oct. 10, 1989

[54] NONIMMERSIVE CRYOGENIC COOLER

[75] Inventor: Scott Buchanan, San Diego, Calif.

[73] Assignee: Biomagnetic Technologies, Inc., San Diego, Calif.

[21] Appl. No.: 187,016

[22] Filed: Apr. 27, 1988

[51] Int. Cl.[4] ..... F25B 19/00

[52] U.S. Cl. ..... 62/51.1; 62/295

[58] Field of Search ..... 62/55.5, 295, 514 R

[56] References Cited

U.S. PATENT DOCUMENTS

| | | | |
|---|---|---|---|
| 4,363,217 | 12/1982 | Venuti | 62/295 |
| 4,539,822 | 9/1985 | Sundquist | 62/295 |
| 4,672,202 | 6/1987 | Crossley, Jr. et al. | 62/514 R |
| 4,745,761 | 5/1988 | Bazaj et al. | 62/295 |
| 4,763,483 | 8/1988 | Olsen | 62/55.5 |
| 4,777,807 | 10/1988 | White | 62/295 |

*Primary Examiner*—Ronald C. Capossela
*Attorney, Agent, or Firm*—Gregory O. Garmong

[57] ABSTRACT

A self contained cryogenic cooler, requiring only electricity to operate, maintains apparatus therein at cryogenic temperatures without introducing liquefied gas, and with a minimum of mechanical vibration. The cooler includes an elongated cylindrical insulated container with an end plate, the container having a vacuum conduction barrier and a heat shield radiative barrier so that the heat flow through the walls is small. The interior of the container and the apparatus are cooled by a mechanical cooler that achieves intermediately low temperatures, and a helium gas expansion cooler providing the final stage of cooling to below about 5K. The mechanical cooler is supported from the end plate on a first support, and the expansion cooler and apparatus are supported from the end plate on a second support independent of the first support, so that minimal vibration from the mechanical cooler is introduced into the apparatus. The apparatus can be cooled to about 4K without being immersed in liquid helium, and with a regular vibrational amplitude of less than about 5 micrometers, which for many applications can be readily filtred electronically.

18 Claims, 2 Drawing Sheets

NONIMMERSIVE CRYOGENIC COOLER

BACKGROUND OF THE INVENTION

This invention relates to a device for maintaining apparatus therein at very low temperatures, and, more particularly, to such a device which does not utilize a large heat sink of liquefied gas.

In several branches of technology, it is necessary to maintain apparatus such as electronic devices at very cold temperatures, approaching absolute zero. In one example that is of interest presently, some electronic devices must operate at a low temperature of about 4K ("K" being the symbol for degrees Kelvin) to reduce electronic noise resulting from thermal fluctuations in circuits, and induce a superconducting state in electronic components. There are many other circumstances where the low temperature is required, as to slow the rate of chemical reactions or to achieve other physical effects.

Most commonly, a cold environment is achieved using a highly insulated container, called a dewar, filled with a cold liquefied gas. For example, nitrogen liquefies at 77K and helium liquefies at 4.2K. Where temperatures near absolute zero (0K) are needed, liquid helium is used as the coolant. A device that resides in a bath of such a liquefied gas is maintained at a temperature that is no higher than the boiling point of the liquid gas, and is often lower. At these very low temperatures, heat rapidly leaks into the liquid helium from the exterior of the container along any available thermal conductor, so that the liquefied gas boils away rapidly unless extreme care is taken to insulate the vessel against heat leaks. When such measures are taken, apparatus in the container can be maintained at such low temperatures almost indefinitely, as long as new liquid gas is periodically added to replace that which boils away.

Providing a container full of liquid helium coolant is possible in many research-oriented facilities. However, liquid helium cannot be readily supplied at other locations such as remote sites where apparatus is to be continuously operated at cryogenic temperatures. Liquid helium is relatively expensive anywhere, and may be prohibitively expensive or completely unavailable at remote sites. The conventional approach also suffers from the drawback that the container must be maintained in an upright position without tilting it too far in any direction, or the helium can leak out or be exposed to warm structure that causes it to boil rapidly. In some instances the rapid bubbling of the helium can cause erroneous measurements in some very sensitive types of devices.

Responsive to these drawbacks with the use of a bath of liquid helium as a coolant, there have been developed systems where the cooling of the interior is achieved by an approach other than a bath of liquid gas, termed a nonimmersive cooling. In one type of device, an appropriate gas such as helium is precooled and piped under pressure into the insulated container and expanded through a nozzle. As the gas expands through the nozzle, it cools and can absorb heat from its surroundings, thereby cooling them. Cryogenic temperatures can be achieved by this approach, but an external gas precooler and insulated gas lines are required.

In another approach, a mechanical precooler is built into the apparatus to precool the gas before the gas is expanded through a nozzle. Such apparatus is built in the form of a "cold finger" in which the elongated mechanical precooler is attached to a top plate of the insulated container, and the expansion cooler and device are built onto the end of the cold finger extending furthest into the container. The drawback of this type of apparatus is that mechanical precoolers vibrate, producing vibrational amplitudes of about 40–50 micrometers or more in the apparatus being cooled. This vibrational amplitude is unacceptably large for some types of sensitive instrumentation to be cooled. Attempts to reduce the vibration have been unsuccessful, and the resulting apparatus has had unacceptably high heat leakage rates and could not maintain cryogenic temperatures for extended periods.

There therefore exists a need for a cryogenic apparatus that maintains a device therein at temperatures near absolute zero for extended periods of time by a nonimmersive technique, and also imparts, at most, very low, controlled, and stable vibrational amplitudes to the device. The present invention fulfills this need, and further provides related advantages.

SUMMARY OF THE INVENTION

The present invention provides a cryogenic cooler that cools a device therein to sustained cryogenic temperatures of less than 10K without immersing the device in liquid gas. The vibrational amplitude imparted to the device is less than 5 micrometers. This cooler is self contained, and can be operated at remote sites where the coolant gas is available only in the gaseous state, not as a liquid. Since a closed gas system is normally used, the only consumable that need be supplied is electricity. The cooler can also be operated in tilted, inverted, or even weightless environments. The cooler apparatus is made of the same size and external configuration as conventional immersion dewars, and with about the same available internal volume.

In accordance with the invention, an apparatus for attaining cryogenic temperatures within its interior comprises an elongated container having insulated walls, one closed end, and an endplate covering the open end of the container; a mechanical precooler supported within the container by a first support joined to the endplate; a gas expansion nozzle supported within the container by a second support joined to the endplate; a gas supply line extending to the gas expansion nozzle from the endplate, the supply line including a first length of supply line contacting and precooled by the mechanical precooler and a second length of supply line connected to the nozzle; and a flexible supply coupling between the first length of supply line and the second length of supply line. An important feature is that there is no rigid interconnection between the first support and the second support, except at the endplate, where there is little adverse vibration.

Mechanical precoolers are available commercially in an elongated form sometimes called a cold finger, as the precooler is constructed so that it produces its coldest temperatures at the end remote from its attachment point. Such mechanical precoolers are structured to have a relatively warm attachment end and a cold end. Cooling is achieved by the mechanical manipulation of gas through an array of tubing within the mechanical precooler, under the influence of a reciprocating piston or displacer, depending upon the type of cooling cycle used.

The mechanical precooler vibrates sufficiently greatly that the vibrational amplitude at the cold end is about 40–50 micrometers. In one prior approach, a magnetic sensing device was rigidly mounted to the cold end of the mechanical precooler, but it was found that the vibrational amplitude imparted to the sensing device by the operation of the mechanical precooler interfered with the magnetic measurements so greatly that the effects could not be electronically filtered and the results were unsatisfactory. In another prior approach, either the mechanical cooler or the magnetic measuring device, or both, was supported externally of the container, producing a two-point support that resulted in satisfactory mechanical isolation of the magnetic measuring device and satisfactory magnetic measurements. However, the two-point support is cumbersome, and such an apparatus is not self-contained.

In the present approach, the mechanical precooler and the device to be cooled are separately supported from the wall of the container, and in particular from the end plate. Two rigid supports are used, with no rigid interconnection between the supports other than through the wall of the container. The mechanical precooler is supported by the first support, and the electronic device and preferably a gas expansion cooler are supported from the second support. The vibration of the device is found to be about an order of magnitude less than the vibration at the cold end of the mechanical cooler. The vibrational amplitude of the device is typically about 2–5 micrometers using the presently preferred embodiment, which is sufficiently small that the effects can be electronically filtered from the device output to achieve a highly sensitive magnetic measurement.

The mechanical cooler and the device remain rigidly connected together in the present apparatus to give it structural strength and stability, through the first support, end plate, and second support. It might therefore be expected that the vibration of the mechanical precooler would be transmitted to the electronic device through this structure. The present invention unexpectedly achieves a greatly reduced vibrational amplitude for the electronic device because the inventor recognized that the large vibrational amplitude at the cold end of the mechanical precooler results from two components, and devised a structure that avoids the effects of the larger of the two.

Specifically, the vibration at the cold end of the mechanical precooler results from the movement of the piston or displacer in the mechanical precooler, and from the stretching of the tubing within the precooler as the gas pressure within the precooler cycles upwardly and downwardly during operation. It was observed that about 90–95% of the vibrational amplitude at the cold end of a commercial Gifford-McMahon cycle mechanical precooler was due to the stretching of the tubing within the precooler, while only about 5–10% resulted from the movement of the displacer. The stretching component of vibration is observed only at the cold end, for a rigidly supported precooler. By mounting the electronic device so that it was independently supported, not from the cold end of the mechanical precooler as in prior practice, the adverse vibrational effects of the stretching of the tubing were avoided completely. The effect upon the magnetic measurements from the remaining small, regular amplitude of vibration of the displacer is nullified by electronic filtering of the device signal.

Thus, a cryogenic apparatus comprises a container having insulated walls; a mechanical precooler within the container and supported from the wall of the container, the mechanical precooler having a vibrational amplitude at its cold end resulting from the stretching of tubing therein and from other sources; and means for supporting a device from a point within the container to avoid the vibration produced by the stretching of tubing within the mechanical precooler.

A gas expansion cooler nozzle, supplied by a supply line, may be mounted on the means for supporting, adjacent the device, as long as the gas line to the expansion cooler is vibrationally isolated from the mechanical precooler. The gas expansion cooler provides the final stage of cooling to near-absolute zero. In such preferred form, however, it is necessary to thermally couple the mechanical precooler to the gas supply line to partially cool the gas prior to its reaching the nozzle, and to use the expanded gas from the nozzle to cool the gas flowing to the nozzle with a counterflow heat exchanger. These precooling procedures have been found acceptable, as long as flexible couplings are used to vibrationally isolate the cold end of the mechanical cooler from the device support and the device itself.

In a preferred embodiment, then, apparatus for cooling an electronic device within its interior to cryogenic temperatures comprises an elongated container having one closed end, an endplate covering the open end of the container, and insulated walls, the insulated walls including a vacuum space and at least one heat shield; a first support joined to the endplate; a mechanical precooler supported within the container by the first support; a second support joined to the endplate, wherein the second support includes two support sections fastened end to end at a second section joint, and wherein a flexible metallic conductor of heat is fastened between the second section joint and the mechanical precooler; a gas expansion nozzle supported within the container by the second support; a gas supply line extending to the gas expansion nozzle from the endplate, the supply line including a first length of supply line contacting and precooled by the mechanical precooler and a second length of supply line connected to the nozzle; a flexible supply coupling between the first length of supply line and the second length of supply line; a gas collector that collects the gas expanded through the nozzle; a gas return line extending from the collector to the endplate, the return line including a first length of return line contacting the first length of supply line to cool said first length of supply line, and a second length of return line connected to the gas collector; a flexible return coupling between the first length of return line and the second length of return line; and an electronic device supported by the second support, the electronic device including means for measuring a magnetic signal.

It will be appreciated that the present invention provides an important advance in the field of low-vibration cryogenic vessels wherein the cooled apparatus is not immersed in a liquid gas. The cryogenic vessel can be used to cool contained apparatus to about 4K, with a vibrational amplitude of about 5 micrometers or less. The apparatus is self contained. It requires only one consumable, electricity, to operate, and does not require the provision of liquified gas, an important consideration at remote sites. The apparatus can be tilted over a wide range of orientations. Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
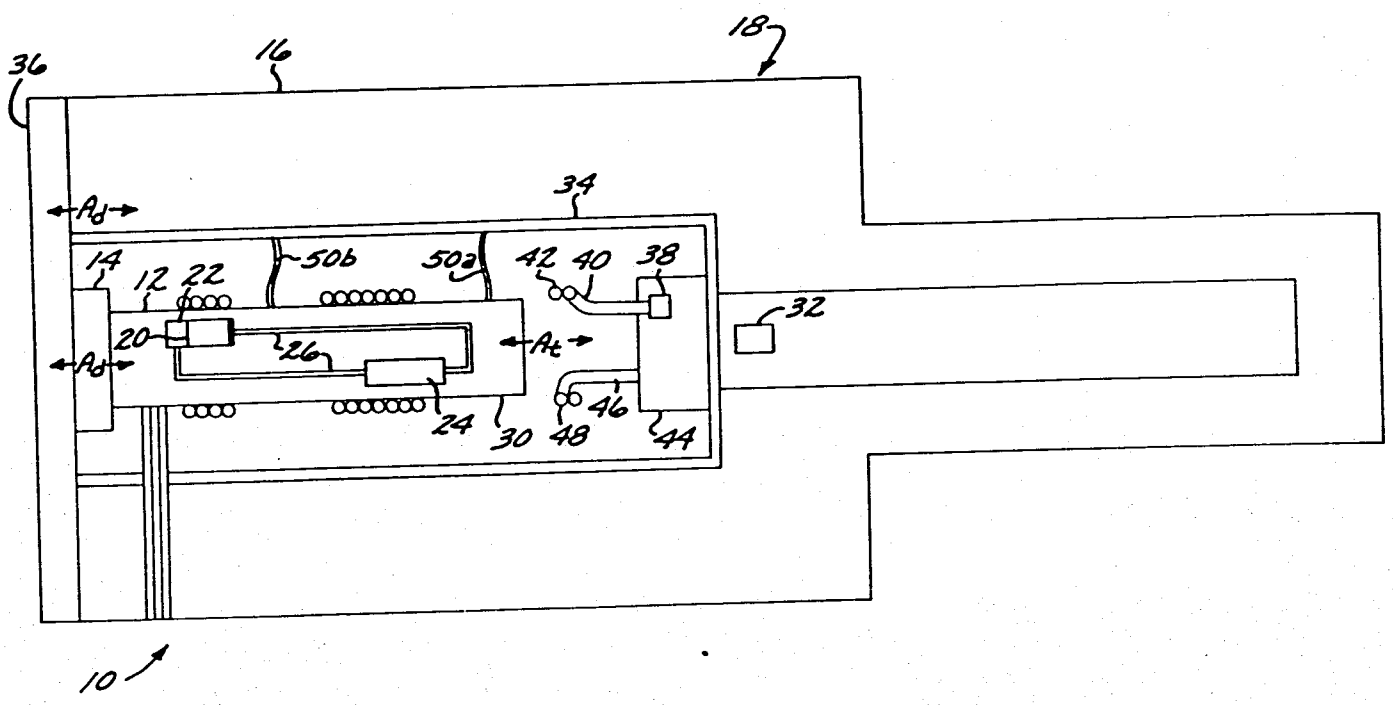
FIG. 1 is a side schematic drawing of the apparatus of the invention.

One form of the apparatus 10 of the invention is depicted schematically in FIG. 1, so that its principles of operation may be illustrated. A mechanical precooler 12 is supported by a first support 14 from a wall 16 of a container 18. The mechanical precooler is necessary to precool the gas that is expanded through a Joule-Thomson gas expansion nozzle to achieve the final stage of cooling. In such precoolers, the heating of gas to remove heat from the interior of the apparatus 10 is achieved by mechanically moving the gas with a displacer 20 in a cylinder 22, and passing it through a regenerator 24. The heated gas is then removed from the apparatus 10, cooled by an external heat exchanger and recompressed by an external compressor, which are not shown. During this process, the gas flows through the interior of the precooler 12 between the cylinder 22 and the other components in tubes 26. The structure and operation of such mechanical precoolers are well known to those skilled in the art, and do not form a part of the present invention. See for example "Cryocoolers, Part I, Fundamentals" by Graham Walker, Plenum Press, 1983 (ISBN 0-306-40715-9), and particularly pages 77 and 245-261 for the preferred Gifford-McMahon cycle mechanical precooler used in conjunction with the present invention.

The present inventor has discovered that the vibrational amplitude at the first support 14 (or base) of the precooler 12 is $A_d$, the vibration due to the operation of the displacer 20 within the precooler 12. The vibrational amplitude at a cold end 30, remote from the first support 14, is $A_t$, which is roughly equal to the sum of $A_d$ and $A_s$, where $A_s$ is a vibrational amplitude produced by stretching of tubing 26 within the precooler 12 as gas is cycled in and out of the interior of the apparatus 10 by operation of the displacer. For a typical commercial Gifford-McMahon cycle mechanical precooler such as the Air Products Model DE-202, $A_d$ is about 2-5 micrometers and $A_s$ is about 40-45 micrometers. If an electronic device is mounted on the cold end 30, as has been the prior practice, the total amplitude $A_t$ of vibration experienced by the device is about 40-50 micrometers. This amplitude is too great to be readily filtered electronically from the signal of the device.

A device 32 to be cooled is therefore mounted from a location that does not experience the amplitude $A_s$. Conveniently, this is accomplished by mounting the device 32 from a second support 34 that is mechanically isolated from the portion of the mechanical precooler 12 which is subject to the $A_s$ component of vibration, such as the cold end 30 and adjacent portions of the precooler 12. Preferably, the first support 14 for the precooler 12 and the second support 34 for the device 32 are both attached to an end plate 36 fastened to the remaining portion of the wall 16 of the container 18. This construction permits the end plate 36, first support 14, mechanical precooler 12, second support 34, and device 32 to be readily removed from the container 18 as a unit.

The mechanical precooler 12 can provide reduced temperatures down to about 10-12K. To cool the device 32 to temperatures below 10K and typically to about 4K, a Joule-Thomson expansion nozzle 38 is mounted on the second support 34 adjacent the device 32. Pressurized helium gas precooled to about 10-12K by the precooler 12 expands through the nozzle 38, cooling the nozzle and the device 32 to the desired low temperature.

To achieve extremely low temperatures, the gas flowing to the nozzle 38 must be precooled by the precooler 12, and the second support 34 must also be intermediately cooled to lessen heat flow down the support. This precooling of the gas flowing to the nozzle 38 and the support 34 must be achieved without transmitting vibration from the mechanical precooler 12 to the device 32.

The gas flowing to the nozzle 38 through a gas supply line 40 is precooled by thermally contacting the line 40 to the precooler 12. A flexible coupling means 42 in the line 40 prevents the transmission of vibration from the cold end 30 of the precooler 12 to the second support 34 and the device 32. The helium gas is collected after expansion through the nozzle 38 in a gas collector 44. The collected gas is returned through a return line 46. The return line 46 is thermally contacted to the supply line 40, so that there is a countercurrent transfer of heat from the gas in the supply line 40 to the gas in the return line 46, further cooling the gas supplied to the nozzle 38. A flexible coupling means 48 in the return line 46 prevents transmission of vibrations from the cold end 30 to the second support 34 and device 32.

The second support 34 is cooled at intermediate locations along its length by contacting it to the mechanical precooler 12 using flexible thermal conductors 50, preferably braided copper wire. This construction prevents transmission of vibrations from the cold end 30 and adjacent regions of the mechanical precooler 12 to the second support 34 and thence to the device 32.

The apparatus 10 thus achieves the benefit of a rigid mechanical construction and support of the mechanical precooler 12 and the device 32, which is necessary for the apparatus 10 to be portable and capable of operation in various tilted configurations. It achieves the benefits of a structure in which the device 32 is not rigidly mounted to the cold end 30 of the mechanical precooler 12, so that the device 32 is not subjected to the high vibrational amplitude characteristic of this portion of the mechanical cooler 12. The apparatus 12 also achieves the benefits of thermal contact of the gas supply line 40 to the return line 46, the gas supply line 40 to the mechanical cooler 12, and the second support 34 to the mechanical cooler 12, all using a flexible thermal conductor approach that does not transmit vibrations to the device 32.

Figure 2:
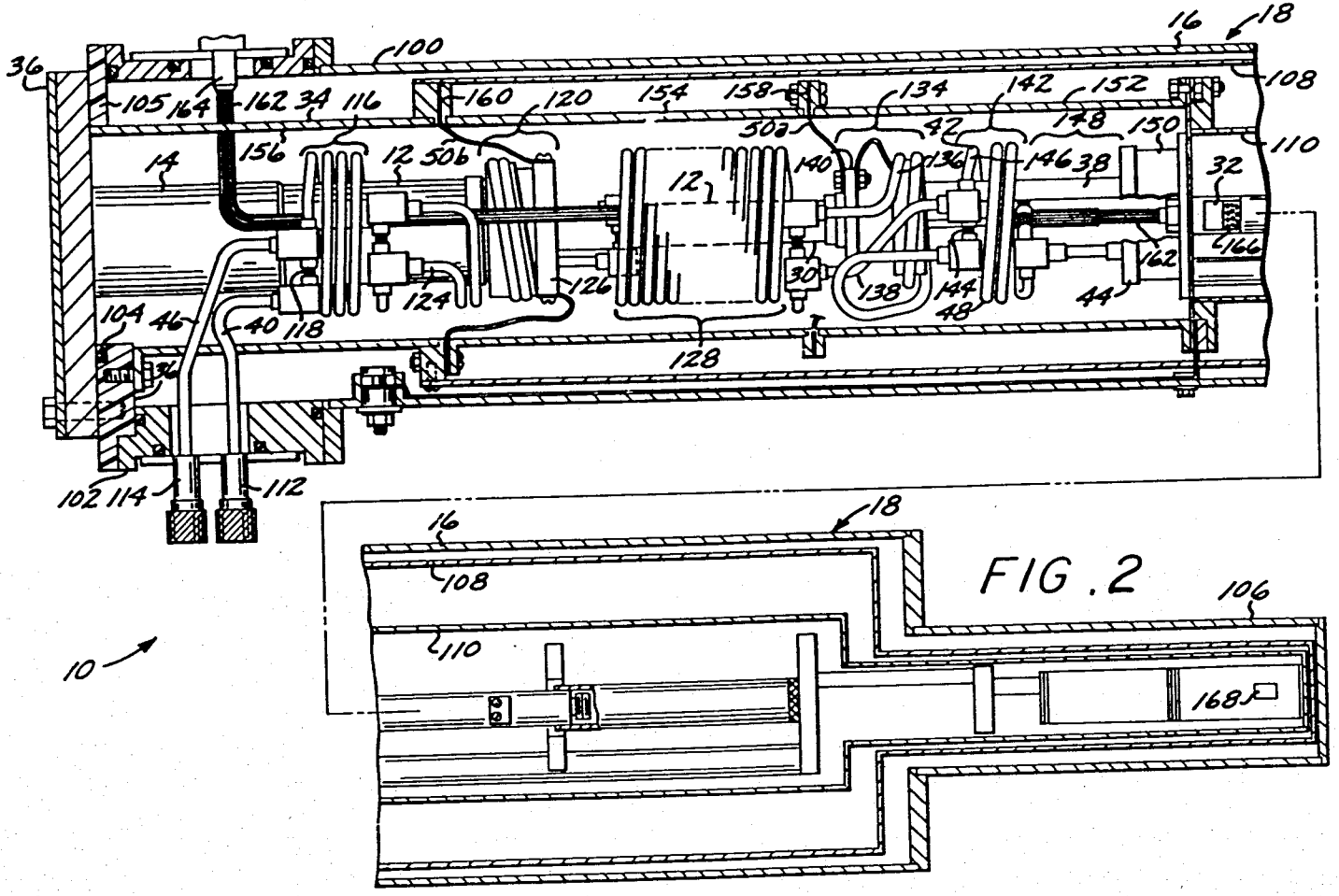
FIG. 2 is a side sectional view of the cryogenic apparatus of the invention.

The apparatus 10 of the present invention is illustrated in more detail in FIG. 2, wherein corresponding elements are numbered as in FIG. 1, together with additional details of construction. In FIG. 2, the container 18 is of elongated cylindrical construction, with two integrally joined but separable portions. A cylindrical main body 100 is closed at one end and provides an enclosed volume which contains the previously described elements 14 and 20-50 therein.

The end plate 36 is bolted to the top end of the main body 100 with a vacuum-tight O-ring seal 104 therebetween so that a vacuum may be pumped on the interior of the container 14. A cylindrical tail piece 106 is of smaller diameter than the main body 100 and is joined to the main body 100 at the end remote from the end plate 36. The tail piece 106 is made to be of smaller diameter, thereby reducing surface area for heat loss, because it contains a portion of the device 32 that is small in size and which is desirably placed near to an object that produces a magnetic field.

In the most preferred embodiment, the outer diameter of the main body 100 is about 6-¼ inches, the length of the main body is 21-¾ inches, the outer diameter of the tail piece 106 is 2-¼ inches, and the length of the tail piece is 6-⅛ inches. These dimensions are not to be taken as limiting, but are presented as illustrative of the size of the apparatus 10 in its preferred form.

The container 18 generally utilizes an established structural approach for the construction of dewars used to contain cryogenic liquids. It is important that the materials of construction used in the container 18, and throughout the apparatus 10, be nonmagnetic in character. A magnetic material would interfere with the measurement of small magnetic fields. If the invention is to be used in other applications where a magnetic measurement is not being taken, other materials of construction can be used.

The container 10, including both the main body 100 and the tail piece 106, has an outer wall 16 of fiberglass. The thickness of the fiberglass wall 16 in the main body 100 is about 3/16 inch, and in the tail piece 106 about ⅛ inch. The fiberglass is vacuum tight even for hard vacuums. A cylindrical fitting 102 is fastened to the upper end of the wall 16, and a nylon ring 105 is fastened to the fitting 102. The groove for the O-ring 104 is machined into the ring 105.

Extending from the bottom of the tail piece 106 to an intermediate position of the main body 100 is a cylindrical first radiation shield 108, formed of copper coil foil and fiberglass. Within the shield 108 is a cylindrical second radiation shield 110 of copper coil foil and silvered cloth. The second shield 110 extends from the bottom of the tail piece 106 to a lower intermediate position of the main body 100. The first shield 108 is generally effective in maintaining an environment within the shield of about 77K or less, and the second shield 110 is generally effective in maintaining an environment within the shield of about 8K or less. The interior of the container 18 is evacuated to reduce thermal conduction heat losses.

The mechanical precooler 12 is a mechanical device that cools its surroundings by absorbing heat through mechanical manipulation of a gas contained within the precooler 12. The preferred precooler 12 used in conjunction with a container 18 of the size described is a Gifford-McMahon mechanical precooler using helium and having a cooling power of about 2 watts at 15K. Such a precooler is available from Air Products as its Model DE-202 cooler, but the present invention is not limited to such a cooler. In the present application wherein the temperature of the device 32 must be about 4K, the gas used is helium, the only common gas with a boiling point that low. The mechanical precooler 12 is supported from the end plate 36 by the first support 14, which is preferably made of fiberglass.

As indicated, the precooler 12 can cool to about 10–12K, and a Joule-Thomson gas expansion of helium gas is used to cool the device 32 to less than 10K. Hollow tubes are used in the supply line 40 to conduct gas to the nozzle 38, and hollow tubes are used in the return line 46 to remove the expanded gas from the apparatus 10 to an external compressor for recycling. The supply line 40 and the return line 46 pass through the end plate 36 with vacuum feedthroughs 112 and 114, respectively.

The supply gas in the supply line 40 is initially at about ambient temperature, and is cooled to about 10–12K by a combination of heat exchange with the mechanical precooler 12 and heat exchange with the return gas in the return line 46. In a first region 116, the inlet gas is passed to a plurality of small diameter inlet gas tubes 118, which collectively form that portion of the supply line 40 in the first stage 116. These tubes 118 are in turn packed within the larger gas return line 46. In the preferred embodiment, the supply tubes 118 are 1/32 inch in diameter, and 11 of these tubes 118 are packed within a 5/32 inch diameter return line 46. The gas return line 46 is coiled with the inlet tubes 118 therein, but there is still sufficient space within the unoccupied portion of the gas return line 46 that previously expanded gas can flow therethrough. The previously expanded gas that forms the return gas flow within the gas return line 46 is quite cold, and is warmed by the pressurized inflowing gas within the tubes 118. This arrangement acts as a counterflow heat exchanger to cool the incoming gas flow with the outgoing gas flow.

In a second region 120, the incoming gas flow is then passed to a full size gas supply line 122, which is coiled side by side with a full size gas return line 124 (whose flow is passed to the tubes 118 in the first region 116). At the bottom end of the second region 120 is a copper block heat sink 126, whose function will be described later.

The inlet gas is then passed to a third region 128, which consists of a coil of gas return line 130, with the inlet gas again conducted in small diameter tubes 132 within the lines 130. Again, the outflowing gas acts in a countercurrent manner to cool the incoming gas.

In the first to third regions, the gas supply line 40 is coiled about and mechanically and thermally connected to, the mechanical cooler 12. The gas in the line 40 is therefore cooled by conduction from the precooler 12 and by the countercurrent heat exchanger effect of the gas in the return line 46. The gas in the supply line 40 therefore becomes progressively cooler with increasing distance from the end plate 36.

The supply gas is then passed to a fourth region 134, which is essentially a mirror image of the second region 120. The supply gas is conveyed in a full size gas supply line 136, and the return gas is conveyed in a return line 138. At the top end of the fourth region 134 is a brass block heat sink 140, whose function will be described later.

The incoming supply gas passes to a fifth region 142, which again is a countercurrent heat exchanger constructed in the manner of the first region 116. The supply gas is conducted in fine supply tubes 144, which are packed inside a return gas line 146. The coiling of the supply line and the return line in the fifth stage 142 is the flexible coupling and means for mechanically isolating the device 32 from the vibration $A_r$ at the cold end 30 of the mechanical precooler 12.

The first to fifth regions act to gradually cool the incoming gas by exchanging heat with the previously expanded outflowing gas and with the mechanical precooler. As a result, the temperature of the incoming gas gradually decreases with distance travelled through the five regions until at the exit to the fifth region 142 its temperature is estimated to be about 10K.

The incoming gas is expanded through the nozzle 38 in a sixth region 148. The diameter of the nozzle is about ½ inch. The upstream gas pressure is about 300 pounds per square inch absolute (psia) and the downstream gas pressure after expansion through the nozzle 38 is about 15 psia. Upon passing through the nozzle 38, the gas cools sufficiently that a small portion may liquefy in a cup 150. The formation of any liquid gas is a natural consequence of the cooling, and is not required for operation of the apparatus. Whether or not liquid is formed, the temperature in the cup 150 is at about 4K. The cooled gas expanded through the nozzle 38 and the liquid gas in the cup 150, if any, extract heat from the device 32 and from the lower portions of the container 18.

The only liquid gas present in the system is that which may be incidentally present in the cup 150. This is at most a small amount, as about 30 cubic centimeters. The device 32 and other structure within the container 18 are not immersed within the liquid gas in the cup 150. This apparatus 10 is therefore of a nonimmersive type, and is contrasted with cryogenic cooling systems wherein large amounts of liquefied gas fill the interior of the container, and the apparatus being cooled is immersed into the liquefied gas.

The device 32 is supported by the second support 34, which is supportively and rigidly attached to the end plate 36. The second support 34 is a cylindrical tube made of fiberglass, which has a low coefficient of thermal conductivity. However, even with a low conductivity, an unacceptably high flux of heat is conducted lengthwise down the second support 34 to the interior of the container 18 to the device 32, in the absence of steps to minimize the heat conduction.

To reduce the conduction of heat, the support 34 is formed as a series, preferably three, of cylindrical segments 152, 154, and 156. Between the first segment 152 and the second segment 154 there is sandwiched and bolted a first copper ring 158, and between the second segment 154 and the third segment 156 there is sandwiched and bolted a second copper ring 160. Each of the copper rings 158 and 160 thermally communicates with the portion of the mechanical precooler 12 at the corresponding station along the length of the support 34. A plurality of braided copper cables 50*a* are bolted to the first copper ring 158 at one end, and to the copper block heat sink 140 (located at the top of the fourth region 134) at the other end. A completely separate and independent plurality of braided copper cables 50*b* are bolted to the second copper ring 120 at one end, and the copper block heat sink 126 (located at the bottom of the second region 120) at the other end.

These cables 50*a* and 50*b* conduct heat from the respective rings 158 and 160 to the respective copper blocks 140 and 126. Because the block 140 is further from the end plate 36, it is colder than the block 126. As a result, the ring 158 is maintained at a temperature colder than the ring 160. The effect of the heat sink rings 158 and 160 is to act as heat sinks and barriers to the flow of heat from the end plate 36 and upper regions of the container 18, toward the bottom end of the container 18 and the device 32, along the second support 34. The temperature within the container 18 is maintained at increasingly lower temperatures with increasing distance from the end plate 36.

The device 32 typically requires electrical connections to external instrumentation. Such connections are provided by running a bundle of instrumentation wires 162 from the device 32 up the central region within the spiralled coils. The wires 162 are then connected to a vacuum-tight electrical feed through 164.

In the preferred embodiment, the device 32 includes a Superconducting QUantum Interference Device (SQUID) 166 positioned relatively near to the nozzle 38, and a magnetic pickup coil 168 positioned near to the bottom of the tail piece 106. The SQUID 166 and coil 168 are electrically interconnected. It is the SQUID that must be cooled to about 4K to reduce its electronic noise and place it into the superconducting state. The pickup coil 168 must be maintained at a low vibrational amplitude.

The present apparatus has been constructed and operated in the manner indicated. Temperatures of about 4K at the SQUID 166 have been attained. The mechanical vibrational amplitude at the pickup coil 168 was measured as a maximum 5 micrometers, and more typically about 2 micrometers. No other presently known nonimmersive type of cryogenic vessel provides this combination of low temperature and low mechanical vibration.

Although a particular embodiment of the invention has been described in detail for purposes of illustration, various modifications may be made without departing from the spirit and scope of the invention. Accordingly, the invention is not to be limited except as by the appended claims.

What is claimed is:

1. Apparatus for attaining cryogenic temperatures within its interior, comprising:
   - an elongated container having insulated walls, one closed end, and an endplate covering the open end of the container;
   - a mechanical precooler supported within the container by a first support joined to the endplate;
   - a gas expansion nozzle supported within the container by a second support joined to the endplate;
   - a gas supply line extending to the gas expansion nozzle from the endplate, the supply line including a first length of supply line contacting and precooled by the mechanical precooler and a second length of supply line connected to the nozzle; and
   - a flexible supply coupling between the first length of supply line and the second length of supply line.

2. The apparatus of claim 1, further including
   - a gas collector that collects the gas expanded through the nozzle;
   - a gas return line extending from the collector to the endplate, the return line including a first length of return line contacting the first length of supply line to cool said first length of supply line, and a second length of return line connected to the gas collector; and
   - a flexible return coupling between the first length of return line and the second length of return line.

3. The apparatus of claim 2, wherein at least a portion of the first length of supply line comprises a plurality of tubes fitted within the first length of return line.

4. The apparatus of claim 1, further including
   - an electronic device supported by the second support.

5. The apparatus of claim 1, wherein the electronic device includes means for measuring a magnetic signal.

6. The apparatus of claim 5, wherein the second support includes two support sections fastened end to end at a second section joint, and wherein a flexible metallic conductor of heat is fastened between the second section joint and the mechanical precooler, thereby cooling the second support.

7. The apparatus of claim 1, wherein the insulation of the container includes a vacuum space and at least one heat shield.

8. The apparatus of claim 1, wherein the mechanical precooler operates with a Gifford-McMahon cycle.

9. The apparatus of claim 1, wherein the first length of supply line is coiled around said mechanical cooler and joined thereto.

10. The apparatus of claim 1, wherein the flexible supply coupling is a coil of tubing, the axis of the coil being parallel to the axis of elongation of the container.

11. Apparatus for cooling an electronic device within its interior to cryogenic temperatures, comprising:

an elongated container having one closed end, an endplate covering the open end of the container, and insulated walls, the insulated walls including a vacuum space and at least one heat shield;

a first support joined to the endplate;

a mechanical precooler supported within the container by the first support;

a second support joined to the endplate, wherein the second support includes two support sections fastened end to end at a second section joint, and wherein a flexible metallic conductor of heat is fastened between the second section joint and the mechanical precooler;

a gas expansion nozzle supported within the container by the second support;

a gas supply line extending to the gas expansion nozzle from the endplate, the supply line including a first length of supply line contacting and precooled by the mechanical precooler and a second length of supply line connected to the nozzle;

a flexible supply coupling between the first length of supply line and the second length of supply line;

a gas collector that collects the gas expanded through the nozzle;

a gas return line extending from the collector to the endplate, the return line including a first length of return line contacting the first length of supply line to cool said first length of supply line, and a second length of return line connected to the gas collector;

a flexible return coupling between the first length of return line and the second length of return line; and an electronic device supported by the second support, the electronic device including means for measuring a magnetic signal.

12. The apparatus of claim 11, wherein the mechanical precooler operates with a Gifford-McMahon cycle.

13. The apparatus of claim 11, wherein the first length of supply line is coiled around said mechanical cooler and joined thereto.

14. The apparatus of claim 11, wherein the flexible supply coupling is a coil of tubing, the axis of the coil being parallel to the axis of elongation of the container.

15. The apparatus of claim 11, wherein at least a portion of the first length of supply line comprises a plurality of tubes fitted within the first length of return line.

16. A nonimmersive cryogenic apparatus, comprising:

a container having insulated walls;

a mechanical precooler within the container and supported from the wall of the container, the mechanical precooler having a vibrational amblitude at its cold end resulting from the stretching of tubing therein and from other sources;

means for supporting a device from a point within the container to avoid the vibration produced by the stretching of tubing within the mechanical precooler;and means for cooling the device to cryogenic temperature without immersing the device in liquid gas.

17. The apparatus of claim 16, further including means for thermally contacting said means for supporting to the mechanical precooler at least one location along the length of the means for supporting with a flexible thermal conductor, to cool the support.

18. The apparatus of claim 16, wherein the means for cooling includes a gas expansion cooler supported upon the means for supporting.

* * * * *